US006880377B2

(12) United States Patent
Kim et al.

(10) Patent No.: US 6,880,377 B2
(45) Date of Patent: Apr. 19, 2005

(54) METHOD FOR DOUBLE ACTION GAS PRESSURE FORMING SHEET MATERIAL

(75) Inventors: Chongmin Kim, Davisburg, MI (US); Gary A. Kruger, Troy, MI (US); Mark G. Konopnicki, Rochester, MI (US); John Norman Johnson, Allenton, MI (US); James Gregory Schroth, Troy, MI (US); Michelle R. Goff, Grand Blanc, MI (US)

(73) Assignee: General Motors Corporation, Detroit, MI (US)

( * ) Notice: Subject to any disclaimer, the term of this patent is extended or adjusted under 35 U.S.C. 154(b) by 232 days.

(21) Appl. No.: 10/274,493

(22) Filed: Oct. 17, 2002

(65) Prior Publication Data

US 2004/0074273 A1 Apr. 22, 2004

(51) Int. Cl.[7] ..... B21D 26/02; B21D 25/00
(52) U.S. Cl. ..... 72/57
(58) Field of Search ..... 72/57, 63; 29/421.1

(56) References Cited

U.S. PATENT DOCUMENTS 4,045,986 A * 9/1977 Laycock et al. ..... 72/60
6,207,089 B1 * 3/2001 Chuang ..... 264/135
6,253,588 B1 7/2001 Rashid et al.
6,513,359 B1 * 2/2003 Binder et al. ..... 72/57
6,581,428 B1 * 6/2003 Friedman ..... 72/57

FOREIGN PATENT DOCUMENTS

DE 4436437 4/1996

* cited by examiner

*Primary Examiner*—Daniel C. Crane
(74) *Attorney, Agent, or Firm*—Kathryn A. Marra

(57) ABSTRACT

A method is disclosed for forming sheet metal articles, such as automotive body panels, having significant curvatures in front-to-back and side-to-side directions. Opposing, complementary, preforming and final shape forming tools are used in a single press. A sheet of superplastically or quick plastically formable sheet metal alloy, heated to a forming temperature, is first stretched against the preform tool using pressurized gas to form a preform that has experienced most of the metal stretching required for the final part shape. The preform is removed from the preform tool and formed against the opposing tool with pressurized gas to obtain the final sheet metal part shape.

12 Claims, 3 Drawing Sheets

METHOD FOR DOUBLE ACTION GAS PRESSURE FORMING SHEET MATERIAL

TECHNICAL FIELD

This invention pertains to high temperature forming of superplastically formable or quick plastically formable metal alloy sheet blanks into articles of complex curvature such as automotive body panels. More specifically this invention pertains to a double action forming tool and method for forming such blanks into sheet metal products with regions of high elongation without extreme uneven thinning or tearing or wrinkling of the sheet metal.

BACKGROUND OF THE INVENTION

Automotive body panels and other sheet metal parts of complex shape can be formed from aluminum alloys of superplastically or quick plastically formable composition and metallurgical microstructure. Superplastic deformation of, for example, Aluminum Alloy 5083 occurs generally between 900 F and 950 F, and the mechanism is grain boundary sliding of very fine grains. Quick plastic deformation of suitable aluminum alloys is described in U.S. Pat. No. 6,253,588, entitled "Quick Plastic Forming of Aluminum Alloy Sheet Metal" to Rashid, et al. Quick plastic forming is practiced at lower temperatures (e.g., 825 F to 875 F) than superplastic forming and often at higher strain rates. In quick plastic forming the deformation is not entirely by grain boundary sliding, it occurs both by grain boundary sliding and dislocation movement. Quick plastic forming produces complex parts with better dimensional quality and reproducibility of the shaped metal than the same parts made by superplastic forming.

Automobile designers and manufacturing engineers cooperate to specify the shape of aluminum alloy body panels that can be successfully formed from the sheet metal. An example of an automotive body panel is a deck lid. A typical deck lid has a generally horizontal surface for covering the top of the vehicle trunk and a generally vertical surface for defining the end of the trunk. Both surfaces usually have a curved shape as they span the vehicle trunk between the opposing vehicle fenders. Furthermore, the deck lid may have a deep pocket shaped recess in the vertical surface for a license plate and for lights that illuminate the plate. Also the deck lid may have a recess at the top of the vertical surface for a center high mounted stop lamp (CHMSL). When a body panel contains such structural features in a single piece of sheet metal consideration must be given to how the metal is formed without wrinkles and tears.

In evaluating the complex shape of such a body panel a finite element analysis can be made of the stretching of the flat sheet metal into the final product. Given the elongation properties of the sheet metal an assessment is made as to whether the part can be made from the available metal stock without tearing or wrinkling of the metal. It is an object of this invention to provide a markedly improved method of using superplastic forming or quick plastic forming as disclosed in the '588 patent to successfully form a sheet metal part of complex shape with a high quality surface.

SUMMARY OF THE INVENTION

This invention is a method of using complementary, internally or externally heated, double action forming tools in a single press and the pressure of a working gas to form a superplastically or quick plastically formable metal alloy sheet metal blank into a sheet metal product of complex shape. The sheet metal blank is given a preform shape involving substantial elongation of the sheet. In a second action of the tools the preform is then shaped into the final product. In a preferred embodiment the metal alloy is a magnesium-containing, aluminum alloy having a fine-grained microstructure (grain size suitably less than ten micrometers) for superplastic or quick plastic forming. Typically the sheet has a thickness in the range of about 0.7 to 3 mm.

The method is particularly applicable to forming the sheet metal into a stretch formed product of complex three-dimensional curvatures with recessed, pocket-like, regions of high elongation. For example, the invention is applicable to the forming of automotive vehicle body panels.

In accordance with the invention an analysis is made of the lines of elongation required to form a final stretch formed part from an initially flat sheet metal blank. The aluminum alloy sheet metal blank will have been produced by a combination of hot rolling and cold rolling to a desired sheet thickness. The cold worked sheet is subjected to a static thermal re-crystallization operation to produce a suitable fine grained microstructure for superplastic or quick plastic forming of the sheet at an elevated temperature of, for example, 925 F. or 850 F., respectively. The sheet may also have at least one surface that has a high quality finish acceptable as an external visible surface of an assembled vehicle. Of course the quality of such a sheet metal blank surface must be preserved throughout panel forming operations. When a forming analysis of the part indicates to the manufacturing engineers that the part cannot be formed in one stretching operation without producing surface defects or tears, use of the subject process may be imperative.

In many instances panels of complex shape can be formed in a single press using usually self-heated, complementary, but not mating, forming tools in a two stage forming process. The tools are in opposing relationship and movable from an open position for insertion of a sheet metal blank. The blank is externally preheated to its forming temperature or heated by radiation and conduction from the tool surfaces. The tools are then moved to a first stage forming position in which the edges of the blank are gripped by a binder ring mechanism and gas pressure is applied to one side of the sheet to preform it against a preform tool surface. The opposing finish shape tool is then moved closer to the preformed sheet in a second stage forming position and gas pressure is applied to the opposite side of the sheet to force it against the finish form tool to complete the shaping of the sheet metal part. The press is then opened for removal of the formed part and insertion of a new blank.

The preform tool is shaped to accomplish a major portion of the stretching and elongation of the sheet. The finish tool completes bends and recessed corners and defines the final shape of the sheet metal produced in this press operation. But, preferably, most of the metal stretching is accomplished in the preform step. In each instance the pressure of a suitable working gas, such as air or nitrogen, is used to push and stretch the sheet against the respective tool surfaces and the pressure is applied to opposite sides of the sheet in the successive preform and finish form steps. Thus, the necessary elongation lines or stretch directions in the sheet to form the part are predetermined. A substantial part of the elongation is accomplished in the preform step especially in the regions of critical deformation. The final elongation is accomplished by forcing the preformed sheet away from the preform tool against the shaping surfaces of the finish shape tool.

Preferably, the preform tool defines a generally concave cavity and the finish form tool has a generally convex punch surface. The blank is inserted between the tools with the high surface quality side facing the cavity tool for the preform step and so that the final forming of the part is accomplished with the back side, the non-critical side, of the blank engaging the punch surface.

This two stage forming process enables parts with complex curvatures, such as the above described deck lid, to be formed in a single press on a double action tool. The practice makes efficient use of the press bed and reduces part-to-part cycle time for making parts having complex shapes including regions of high elongation.

Other objects and advantages of the invention will understood from a detailed description of a preferred embodiment which follows.

DESCRIPTION OF THE PREFERRED EMBODIMENT

Figure 1:
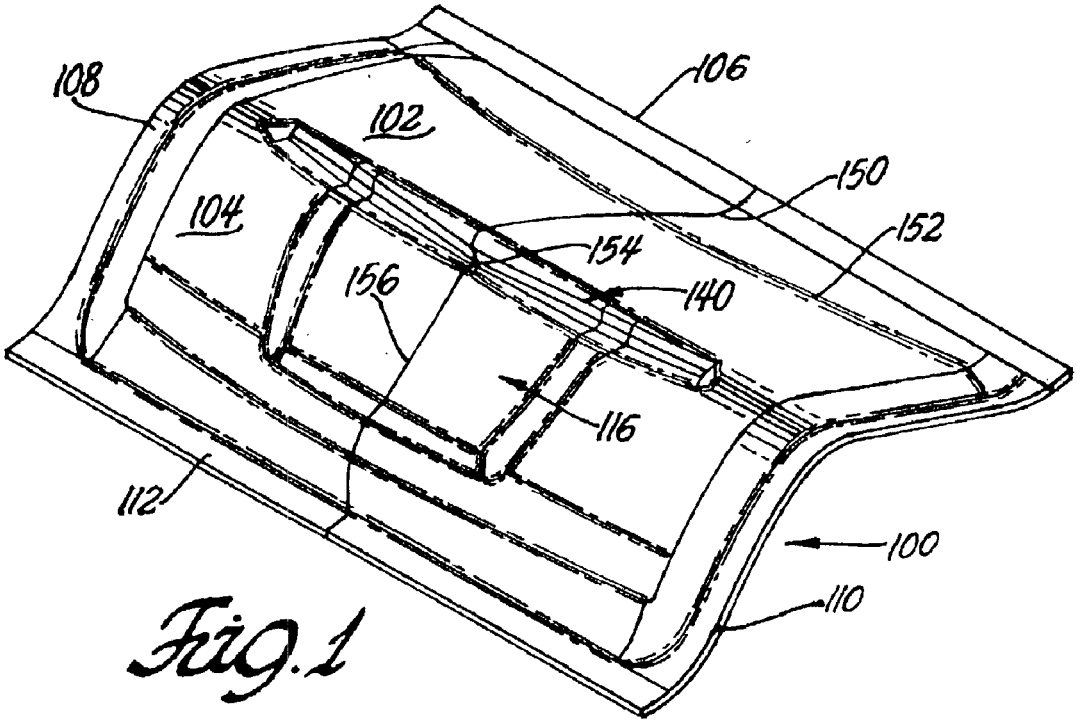
FIG. 1 is an isometric view of a preform structure from an AA5083 sheet metal blank of an automotive deck lid formed in accordance with this invention. In general the lines on the figure are silhouette lines of bends or other elongations in the sheet metal.

This invention is a process for the forming of superplastic or quick plastic metal alloy sheet blanks into articles of complex curvature and relatively high elongation. It is known that certain alloys of aluminum, magnesium, titanium, and steel, for example, can be subjected to relatively high elongation before they tear or crack. Typically, these superplastic metal alloys are processed in the form of sheet metal having a thickness of about 0.7–3 mm. In this sheet metal form, they can be heated to a suitable elevated temperature at which their high elongation forming properties can be exploited and they can be stretched and/or drawn over a suitable tool, or between suitable tools, to form sheet metal articles of complex shape. The practice of this invention will be illustrated using a known high elongation, fine grained, aluminum alloy, AA5083, which has been used for the manufacture of automobile body panels and the like. The same metal sheet can be formed by superplastic forming, SPF, or quick plastic forming, QPF. SPF is usually carried out at higher temperatures and lower strain rates. Progressively increasing gas forming pressures can be used in QPF at faster forming rates. The '588 patent is hereby incorporated by reference for its disclosure of QPF processes.

AA5083, has a typical composition by weight of about 4 percent to 5 percent magnesium, 0.3–1 percent manganese, a maximum of 0.25 percent chromium, about 0.1 percent copper, up to about 0.3 percent iron, up to about 0.2 percent silicon, and the balance substantially all aluminum. Such a composition is usually cast by a suitable process, and the casting is first hot rolled and then cold rolled to form a sheet with a thickness from about 0.7 to about 3 mm. After such cold rolling, usually one or both of the cold rolled surfaces of the sheet have a very smooth finish which is suitable for the external surface of an automobile body panel.

The cold rolled sheet metal has a severely worked, elongated grain microstructure that is not yet suitable for a forming operation. The sheet material is annealed at a suitable temperature and for a time sufficient to recrystallize the cold worked grain structure. For SPF, QPF or other high elongation forming in accordance with this invention the metallurgical microstructure of the sheet material is a stable uniformly fine grain structure in the range of about 5–10 micrometers. The microstructure is characterized by a principle phase of a solid solution of magnesium and aluminum with well distributed, finely dispersed particles of intermetallic compounds containing minor alloying constituents, such as $Al_6Mn$. These aluminum-magnesium alloys can be heated to temperatures of the order of 850 F to 950 F, allowed to recrystallize into a fine-grained microstructure, and then subjected to tensile type strains at a rate of $10^{-4}$ to $10^{-3}$ seconds$^{-1}$ to experience an elongation of up to 300% or more before tearing or other failure.

There is a class of automotive panels, such as deck lid outer panels, which, because of their visible surface quality requirements, are formed in such a way that the inside of the panel is in contact with the forming tool surface, often called the punch surface, and the exterior surface is left untouched. A key shape characteristic of such panels is the presence of two, large convex curvatures, which sweep the panels in both the cross-car and the car-length directions. When attempts are made to form such shapes starting from flat blanks, there is a high likelihood that wrinkles or metal folds occur at areas with male corners, that is, areas having entry corners in two directions at an angle. It is found that a good way to overcome this problem is to have a preform shape that is represented by large curvatures, yet has sufficient length-of-line for the final shape, and the surface of which is sufficiently close to potentially problematic areas of the final shape so that no wrinkling and metal folding tendencies would be expected during the final forming. Experience has shown that forming of a deck lid outer panel without utilizing a suitable preform generates metal folds that bridge the binder surface and the crown of the deck lid.

Two-stage forming can also reduce the overall forming time significantly. Since preforming results in an intermediate panel having large curvatures, and the time for gas-pressure forming is, roughly, inversely proportional to the final panel curvature, the preforming stage takes only a short time. Since this panel has already sufficiently large length-of-lines, the second, and final, forming stage causes mostly bending-like deformation instead of time-consuming metal stretching.

A structural advantage of a panel made with two-stage gas-pressure forming process is that, since the preformed panel with large curvatures has more evenly distributed forming strains, the final product also has a more even thickness distribution compared to that formed in a single-stage tool.

The practice of the invention on an AA5083 superplastic aluminum alloy sheet having, for example, 1.2 mm thickness will be described in connection with the forming of an automobile deck lid outer panel. A preform of the deck lid from a blank of AA5083 sheet metal is illustrated in FIG. 1 and the final form of the deck lid sheet metal panel is illustrated in FIG. 2.

Figure 2:
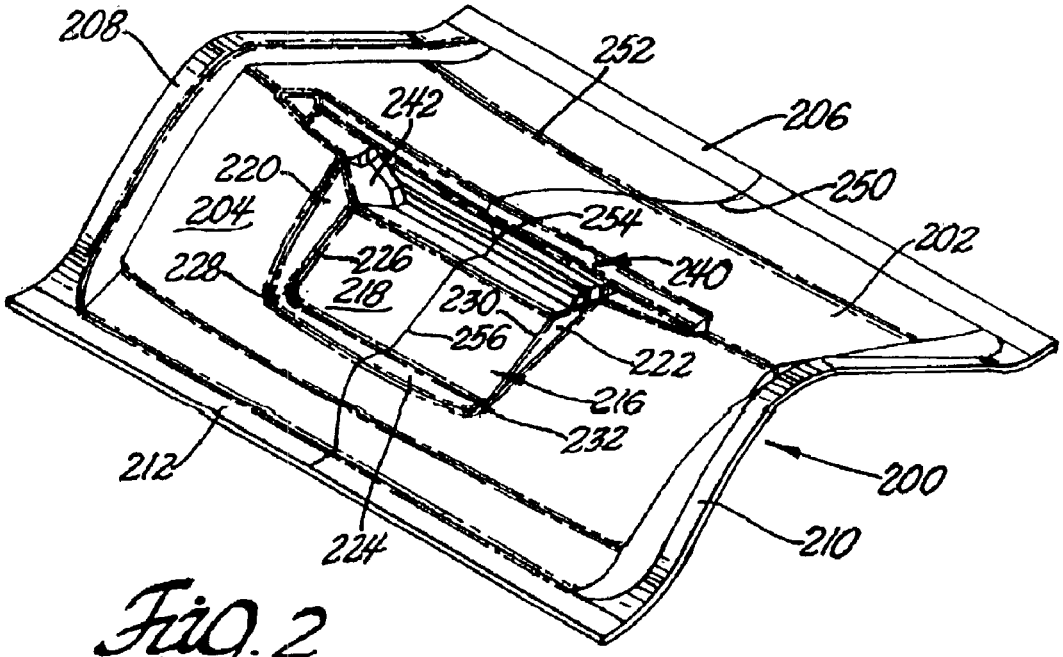
FIG. 2 is an isometric view similar to FIG. 1 of final formation of the deck lid in accordance with this invention.

FIG. 2 will be referred to first for the purpose of describing the general shape, characteristics of an un-trimmed deck lid outer sheet metal panel as it is formed and removed from the tooling used in carrying out the process. The deck lid is indicated generally at 200 in FIG. 2. The lines of FIG. 2 illustrate the general shape of the deck lid that is formed in the original sheet metal blank. But the lines also show elongation lines and bends in the metal as it is formed by the process which will be described in more detail below.

As stated, FIG. 2 represents the formed sheet metal blank that has been shaped to contain a deck lid outer panel configuration 200. Excess metal at the edges of the formed sheet metal has not been trimmed away. In general, the deck lid configuration 200 comprises a horizontal surface 202 which covers the top of the trunk of the vehicle. Deck lid panel 200 also comprises a generally vertical surface 204 which defines the end of the trunk region of the vehicle. Edge 206 of the formed sheet metal contains material that can be used as a flange for attaching an inner panel to this outer deck lid panel 200 and the balance of the edge at 206 may be trimmed away in the finishing of the deck lid outer panel. Side edges 208 and 210 likewise represent flange material for securing an inner deck lid panel and trim stock that may ultimately be cut away from this formed sheet metal part. Finally, edge 212 at the bottom of vertical portion 204 of the deck-lid 200 also provides flange and trim material.

A first significant feature critical to the successful forming of the deck lid panel 200 is an integrally formed pocket 216 for a license plate. The integrally formed license plate pocket 216 includes a generally flat bottom 218 with steeply sloped sides 220 and 222 and 224. Side 220 forms a sharp radius corner portion 226 with bottom 218. Side 220 also forms a corner portion 228 with adjacent side 224. Similarly, side 222 forms a corner 230 with bottom portion 218 and a corner portion 232 with side 224. These are all features that have to be formed in the license plate pocket 216 that is integral with the sheet metal of the rest of the deck lid structure 200.

Also, integrally formed in the deck lid structure is a long narrow pocket 240 for a vehicle stop light that is called a center high mounted stop light (CHMSL). This long, narrow, and deep CHMSL pocket 240 has base portions and side walls that are not specifically labeled here for simplicity of illustration. But they do represent critical, difficult to form, structural features in the sheet metal panel 200. Furthermore, the license plate recess 216 shares connected surfaces, not specifically labeled for simplicity of illustration, with the CHMSL pocket 240. There are also two smaller pockets for back-up lights, one of which is visible in FIG. 2 at 242. The back-up light pocket lies between license plate pocket 216 and CHMSL pocket 240. These are complex, three-dimensional structural features of a modern automobile body panel that test the formability of the sheet metal material from which such a body panel is formed.

As seen in FIG. 2 there is a central elongation line 250, which extends from edge 206, across the upper surface 202 of the deck lid 200, through the CHMSL pocket 240 and adjacent license plate pocket 216, across the vertical surface 204 to lower edge 212. The path traced by elongation line 250 illustrates a region of significant and relatively large elongation in the sheet metal from which deck lid outer panel 200 is formed.

Elongation line 250 crosses bend line 252 in the horizontal surface 202 of the deck lid. Elongation line then experiences a deep "U" portion 254 as it follows the bottom and side portions of the CHMSL pocket 240. Elongation line 250 then traces across the bottom 218 of license plate pocket 216 at 256 and up the side wall 224 of the license plate pocket 216. Elongation line 250 with its many sharply formed segments represents forming features in the final shape of panel 200. Accordingly, elongation line 250 will represent the section of the sheet metal panel 200 as it is seen in the press forming operations illustrated in FIGS. 3A through 3F which will be described in detail below.

FIG. 100 illustrates a preformed configuration 100 of the deck lid panel. Preform configuration 100 is the first stage forming configuration of the initially flat sheet metal AA5083 stock material. Much of the metal stretching and elongation for producing the final deck lid configuration has been produced in this preform. The original sheet metal blank has been sufficiently deformed at this preformed stage so that it is recognizable as a precursor of the deck lid structure illustrated in FIG. 2. The labeled bend lines and formed surfaces in this preform deck lid panel configuration 100 utilize "100" series numbers that otherwise correspond to similarly labeled, further formed lines and surfaces in FIG. 2. In other words, the horizontal deck lid surface of FIG. 1 is 102 and the vertical surface of the pre-formed deck lid structure is 104. Edges 106, 108, 110, 112 are precursor or pre-formed structures that correspond respectively to panel edges 206, 208, 210, 212 in FIG. 2. Similarly, license plate pocket 116 is the pre-formed version of license plate pocket 216 in the final form deck lid structure 200 of FIG. 2 and CHMSL pocket 140 is the preformed or precursor of the CHMSL pocket 240 in FIG. 2. Elongation line 150 is the pre-formed version of elongation line 250 in FIG. 2.

Again, elongation line 150 traces a path across bend line 152 in the horizontal surface 102 of preform panel configuration 100. Elongation line 150 has a "U" shaped portion 154 in the preform CHMSL pocket 140. Elongation line 150 continues as 156 across the preform license plate pocket 116 and ultimately reaches the preform edge 112 of the pre-formed panel structure 100. Again, the preform elongation line 150 will be seen as a sectional view of the pre-formed structure 100 in the detailed description of the forming tools and the forming operation which will be described below in connection with FIGS. 3A–3F.

FIGS. 3A–3F are a series of schematic illustrations in cross section of an elevation view of press platens and two complementary, but not mating, forming tools useful in a preferred embodiment of the invention. They illustrate the forming the deck lid panel preform configuration 100 as illustrated in FIG. 1 and then the deck lid panel final configuration 200 as seen in FIG. 2. The respective tooling components are given the same identifying numbers when they are shown in more than one of the FIGS. 3A–3F.

Figure 3A:
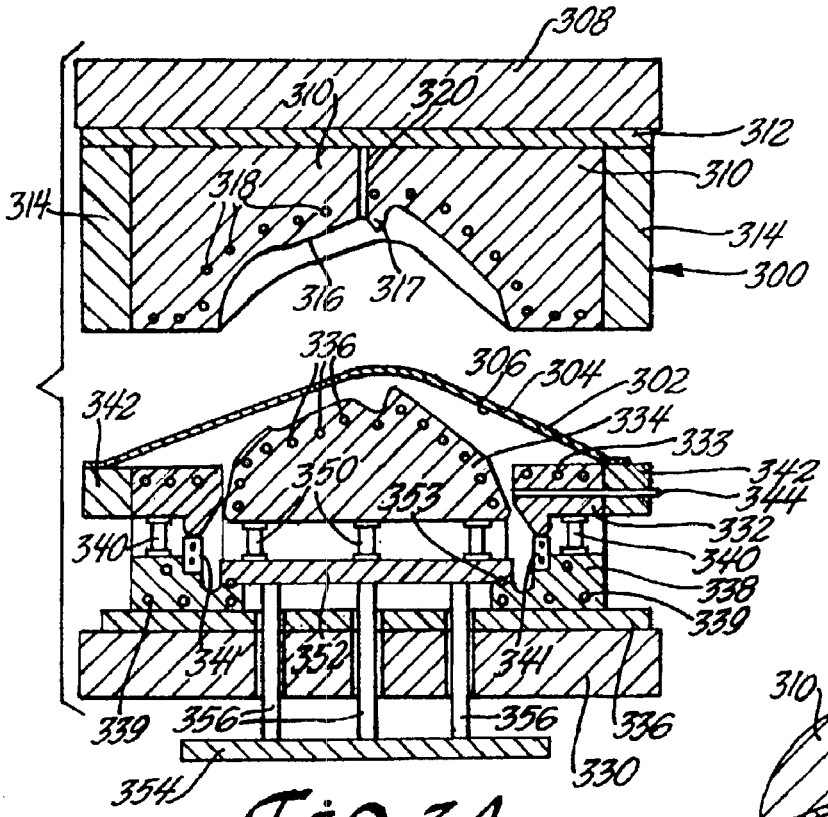
FIGS. 3A–3F are a series of cross sectional views of the progressive operation of forming tools mounted on a press for superplastic or quick plastic stretch forming of the deck lid preform and final shape in accordance with a preferred embodiment of this invention.

Referring first to FIG. 3A, the press and tooling assembly is indicated generally and schematically at 300 and is shown in an open position for the insertion of a sheet metal blank 302. Blank 302 is shown in cross section and on edge. Sheet metal blank 302 has an upper surface 304 and a lower surface 306.

The press and tooling combination 300, comprises an upper press platen 308 (the full press structure and hydraulic actuating mechanisms are conventional and not shown to reduce the complexity of the illustration). Securely attached to upper press platen 308 is a cavity defining tool 310 which is generally concave in configuration with the principal exception of a CHMSL pocket preform shaping portion 317. An insulation layer 312 thermally isolates cavity tool 310 from upper platen 308. Similarly, the sides of cavity tool 310 are wrapped in insulation layers 314. Cavity tool 310 includes a cavity portion 316 for use in shaping the deck lid panel preform 100. Cavity tool 310 also comprises a plurality of heating elements 318 for maintaining the cavity tool at a temperature suitable for the thermoplastic forming of the AA5083 sheet material. An illustrative temperature for QPF is, for example, 850 F. Cavity tool 310 also includes a gas port 320 for admitting a working gas under pressure for a forming operation to be described below. Air or nitrogen is typically used as the working gas. The working gas is vented through gas port 320 when the forming operation is completed.

The press lower platen 330 carries a binder ring 332 and a punch tool 334. Lying on press lower platen 330 is a layer of insulation material 336. Insulation layer 336 carries a water cooled support structure 338 for binder ring 332. The water passages are indicated at 339. Support structure 338 carries cylindrical columns 340 for carrying binder ring 332. Enclosing binder ring 332 is an insulation ring 342. Binder ring 332 contains heating elements 333. Punch 334 likewise contains heating elements 336 for maintaining the punch tool at the specified forming temperature of the sheet metal blank 302. As seen in FIG. 3A, the preheated sheet metal blank 302 is initially deposited on convex punch 334 when the press/tool assembly 300 is in its open position. The hot flexible sheet drapes itself over punch 334 and binder ring structure 332.

Gas port 344 through insulation 342 and binder ring 332 permits the introduction of working gas against the back side 306 of sheet blank 302 during the preform step as will be described below. Sealing ring 341 between binder ring 332 and support 338 helps seal the working gas within the press/tool assembly during the preform step (as better seen in FIG. 3B).

With the flat sheet metal blank 302 loaded in the open press/tool assembly 300, the forming process now proceeds as follows.

Figure 3C:
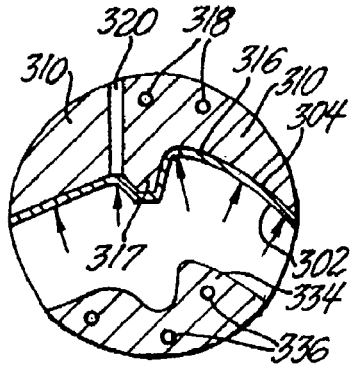
Figure 3B:
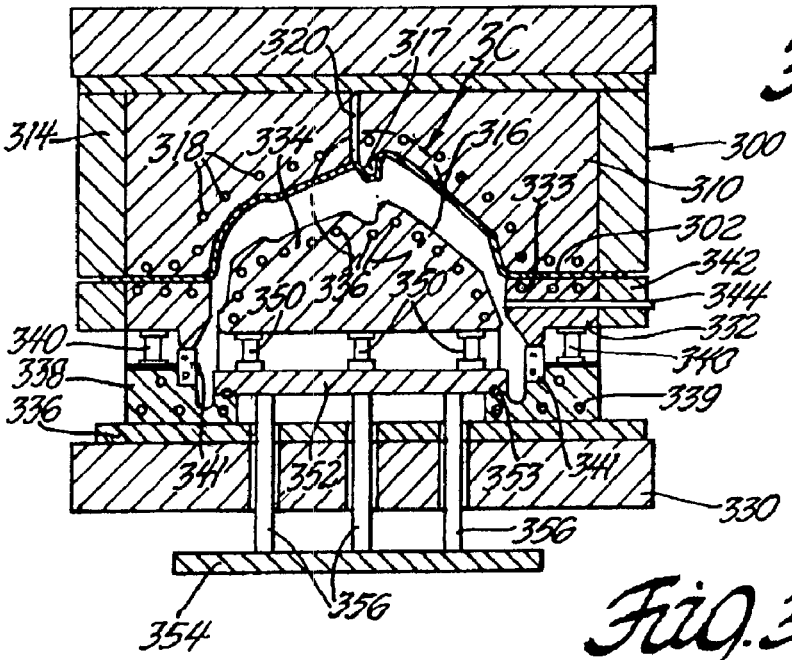

Referring to FIG. 3B, the upper press platen 308/cavity tool 310 assembly is now closed against the punch 334/binder ring 332 combination. Relative movement of upper platen 308 and lower platen 330 closes the press/tool assembly 300 to the FIG. 3B position. Cavity tool 310 is now positioned close to the punch tool 334. In this closed position of the press/tool assembly 300, cavity tool 310 and binder ring 332 tightly secure the periphery of the sheet metal blank 302. The secured blank 302 thus closes the press space around punch 334 so that working gas pressure can be maintained against lower side 306 of blank 302. There is an additional sealing feature in the press/tool assembly 300 which is described below.

Air under suitable pressure is introduced through duct 344 so that air pressure is applied to the lower side 306 of blank 302. This pressure forces the preheated blank 302 against the cavity surface 316, including CHMSL pocket preform portion 317, of the cavity tool 310 and into full compliance with the cavity tool, preform shaping surface. The view in FIGS. 3B and 3C is a sectional view of the preform 100 of FIG. 1 along elongation line 150.

FIG. 3C is an enlarged view of the circled region of FIG. 3B. As seen in the FIG. 3C, the air pressure, indicated by the directional arrows, is forcing upper surface 304 of blank 302 into shape compliance with the CHMSL pocket forming portion 317 of the preform shaping surface of cavity tool 310 and the rest of the cavity tool 310 forming surface 316.

The air pressure is suitably applied in appropriate increasing increments as described in the Rashid et al patent, '588. Within a period of a few minutes the heated blank 302 has assumed the deck lid panel preform shape 100 as illustrated in FIG. 1. When the stretching of the preform 100 has been completed the working gas is released through gas port 344. Most of the metal stretching required to make the final deck lid shape is introduced in the preform 100. Final bending and corner details and the like are accomplished in the next forming stage.

Figure 3D:
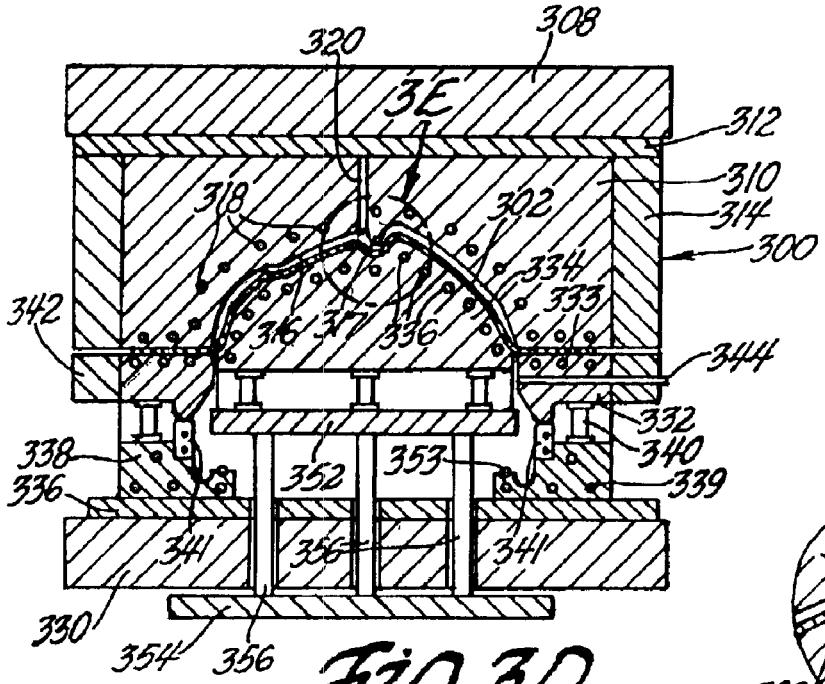
Figure 3E:
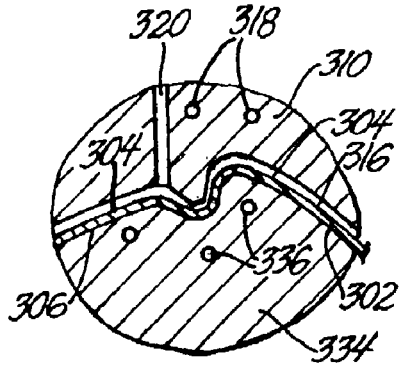
Figure 3F:
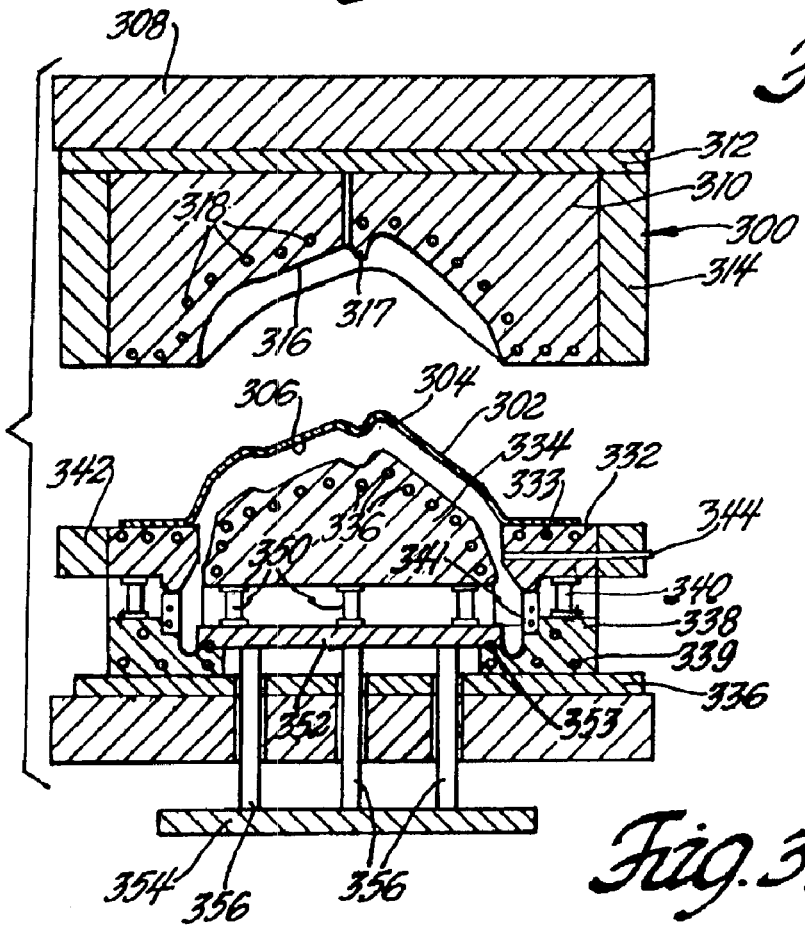

As shown in FIGS. 3A, 3B and 3F, punch tool 334 is carried by the lower press platen 330 at support ring 338 but is movable separately from platen 330. Punch tool 332 is carried on cylindrical supports 350 which are carried on plate 352. In FIGS. 3A, 3B and 3F, plate 352 rests on support ring 338. O-ring 353 mounted in a groove in water cooled support ring 338 provides a gas seal for the above described preform operation when plate 352 rests on it.

Plate 352 is connected to punch platen 354 by rods 356 which extend through insulation plate 336 and press platen 330. Rods 356 are based on platen 354. Punch platen 354 is actuated by means, not shown, to move punch 334 independently of the motion of press lower platen 330. This independent motion of punch 334 provides the "second stage" operation of the subject tooling and forming process.

After sheet metal blank 302 has been shaped as preform panel 100 as illustrated in FIGS. 3B and 3C the punch tool 334 is raised for the final sheet metal forming step. In FIG. 3D it seen that punch platen 354 has been raised and the surface of the punch 334 is now in closer proximity with the cavity tool 310. Air is vented from between the punch 334 surface and the sheet metal 302 (now in the shape of preform 100) through duct 340 in the binder ring 332. Air pressure is now introduced through the cavity tool 310 through gas duct 320. The sheet metal 302 is forced away from the surface of the cavity tool 310 and it is stretched into contact with the surface of punch tool 334 as shown in the enlarged view of FIG. 3E. Back surface 306 of sheet metal 302 is in full contact with the surface of punch 334. Again, the air pressure is gradually increased in increments as described in the Rashid et al patent and within a period of a few minutes the sheet metal (shaped as preform 100, FIG. 1) has been stretched against the surface of the punch tool 334 so that it assumes the final deck lid panel configuration 200, FIG. 2, obtained in this tool/press assembly 300. The air pressure is then released through gas duct 320.

As illustrated in FIG. 3F, the cavity tool 310 and punch tool 334 are now separated by activation of their respective platens 308, 330 and 354. The formed sheet metal 302, which is now in the configuration of final formed deck lid panel sheet 200 (FIG. 2), is seen resting on the binder ring 332 in the open tooling/press assembly 300.

Sheet metal 302, now deck lid panel sheet 200, is removed from the tool/press assembly 200. Any trimming operations and the like are accomplished to finish the making of the deck lid outer panel. The press is now in its open position and the tooling is ready for the insertion of a new blank 302 so that the process starts again to form the next deck lid panel as illustrated in FIG. 3A.

Thus, the subject invention provides a practice for two-stage forming in a single press of a deck lid outer panel sheet from a flat sheet metal blank. Much of the elongation that is to be produced in the sheet metal blank is accomplished in a preform step. This stretching and extending of the blank into the preformed shape permits the final detail forming of the license plate pocket and CHMSL pocket to complete the formation of this complex panel structure.

The practice of the invention has been described in the example of forming of aluminum alloy AA5083 sheet metal blank into an automotive deck lid outer panel. However, it will be appreciated that similar practice can be applied to other SPF, QPF or other high elongation formable sheet metal alloys and to the forming of other articles of manufacture. Accordingly, the scope of the invention is not to be considered limited by the description of a specific example.

What is claimed is:

1. A method of forming a sheet metal article from a blank of sheet metal that has been heated for stretch forming, said method being performed using a set of opposing tools, said tools comprising a punch having a surface defining a predetermined finish configuration for said article and a cavity tool having a cavity surface defining a preform configuration for said article, said method comprising:

placing said blank between said opposing tools, said blank having a first side surface facing said cavity tool and a second side surface facing said punch;

applying gas pressure to the second side surface of said blank to press said first side surface of said blank against said cavity surface, but not against said punch surface, to stretch and shape said blank into said preform configuration;

moving said punch surface toward said blank in said preform configuration without contacting said blank; and applying gas pressure to said first side surface of said blank to push said first side of said blank from contact with said cavity surface and to press said second side surface against said punch surface, but not against said cavity surface, to further stretch and shape said blank from said preform configuration to said finish configuration.

2. A method as recited in claim 1 comprising independently heating each of said opposing tools to a sheet metal stretch forming temperature and applying gas pressure to the second side surface of said blank to press said first side surface of said blank against said cavity surface, but not against said punch surface, to stretch and shape said blank into said preform configuration, the amount of stretching and shaping of said blank to form said preform being such that the further stretching and shaping of said preform to said finish configuration does not tear or wrinkle said article.

3. A method as recited in claim 1 in which said blank has a thickness in the range of 0.7 to 3 millimeters.

4. A method as recited in claim 2 in which said blank has a thickness in the range of 0.7 to 3 millimeters.

5. A method as recited in claim 1 in which said blank is a magnesium-containing aluminum alloy having a grain size of about ten micrometers or less.

6. A method as recited in claim 2 in which said blank is a magnesium-containing aluminum alloy having a grain size of about ten micrometers or less.

7. A method of forming a sheet metal article from a blank of sheet metal that has been heated for stretch forming, said method being performed using opposing tools mounted in a press, said tools comprising a punch having a surface defining a predetermined finish configuration for said article and a cavity tool having a cavity surface defining a preform configuration for said article, said method comprising:

placing said blank between said opposing tools, said tools then being in an open position, said blank having a first side surface facing said cavity tool and a second side surface facing said punch;

moving said tools to a first stage closed position in which said blank is not in contact with either said cavity surface or said punch surface;

applying gas pressure to the second side surface of said blank to press said first side surface of said blank against said cavity surface, but not against said punch surface, to shape said blank into said preform configuration;

moving said tools to a second stage closed position in which said punch surface is moved toward said blank in said preform configuration without contacting said blank; and applying gas pressure to said first side surface of said blank and to push said first side of said blank from contact with said cavity surface and to press said second side surface against said punch surface, but not against said cavity surface, to shape said blank from said preform configuration to said finish configuration.

8. A method as recited in claim 7 comprising independently heating each of said opposing tools to a sheet metal stretch forming temperature and applying gas pressure to the second side surface of said blank to press said first side surface of said blank against said cavity surface, but not against said punch surface, to stretch and shape said blank into said preform configuration, the amount of stretching and shaping of said blank to form said preform being such that the further stretching and shaping of said preform to said finish configuration does not tear or wrinkle said article.

9. A method as recited in claim 7 in which said blank has a thickness in the range of 0.7 to 3 millimeters.

10. A method as recited in claim 8 in which said blank has a thickness in the range of 0.7 to 3 millimeters.

11. A method as recited in claim 7 in which said blank is a magnesium-containing aluminum alloy having a grain size of about ten micrometer or less.

12. A method as recited in claim 8 in which said blank is a magnesium-containing aluminum alloy having a grain size of about ten micrometer or less.

* * * * *